US007194222B2

(12) United States Patent
Murooka

(10) Patent No.: US 7,194,222 B2
(45) Date of Patent: Mar. 20, 2007

(54) IMAGE FORMING APPARATUS WHICH COOLS AN IMAGE FORMING CARTRIDGE

(75) Inventor: Ken Murooka, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/927,022

(22) Filed: Aug. 27, 2004

(65) Prior Publication Data

US 2005/0232653 A1 Oct. 20, 2005

(30) Foreign Application Priority Data

Aug. 28, 2003 (JP) ..... 2003-304552

(51) Int. Cl.
*G03G 21/20* (2006.01)

(52) U.S. Cl. ..... 399/92

(58) Field of Classification Search ..... None
See application file for complete search history.

(56) References Cited

U.S. PATENT DOCUMENTS 5,089,846 A * 2/1992 Tabuchi ..... 399/167
5,262,824 A * 11/1993 Morita et al. ..... 399/25
5,884,117 A 3/1999 Tanoue et al. ..... 399/1
6,603,938 B2 * 8/2003 Tsubakimoto ..... 399/92
6,909,864 B2 * 6/2005 Komatsubara ..... 399/92

FOREIGN PATENT DOCUMENTS

| | | |
|---|---|---|
| JP | 6-161199 | 6/1994 |
| JP | 10-20595 | 1/1998 |
| JP | 11-218987 | 8/1999 |
| JP | 2000-293089 | 10/2000 |

* cited by examiner

*Primary Examiner*—Quana Grainger
(74) *Attorney, Agent, or Firm*—Fitzpatrick, Cella, Harper & Scinto

(57) ABSTRACT

The image forming apparatus includes a supply device which supplies a recording material, a cartridge including a photosensitive member and image forming apparatus and detachably mounted on a main body of the apparatus, the cartridge being capable of forming an unfixed image on the recording material supplied and conveyed by the supply device, a fixing device which fixes the unfixed image onto the recording material, and an air blowing device which is provided between the supply device and the cartridge and which blows air toward the cartridge, and the supply device, the cartridge and the fixing device are positioned from below to above in this order. Thus the influence of heat from the fixing device to the cartridge can be reduced.

6 Claims, 8 Drawing Sheets

IMAGE FORMING APPARATUS WHICH COOLS AN IMAGE FORMING CARTRIDGE

BACKGROUND OF THE INVENTION

1. Field of the Invention

The present invention relates to an image forming apparatus for forming an image on a recording material such as an electrophotographic copying apparatus, a printer or a facsimile apparatus, and more particularly to an image forming apparatus in which the interior thereof is cooled.

2. Related Background Art

An image forming apparatus constituting a background technology of the present invention and utilizing an electrophotographic process or another recording method is shown in FIGS. 3, 4 and 5.

FIGS. 3, 4 and 5 are cross-sectional views of a laser beam printer 100.

In a laser beam printer 100, a conveying path for a recording material (hereinafter represented as sheet) P from recording material supply means S through transfer means (transfer roller 9) to fixing means F generally has three configurations: namely a substantially horizontal configuration as shown in FIG. 3, an inclined configuration as shown in FIG. 4, and a substantially vertical configuration as shown in FIG. 5.

In the laser beam printer 100 shown in FIG. 3, a lower end of a sheet feeding tray 6 and a sheet feeding roller 2 are positioned at a right side of the apparatus, while a transfer roller 9 is positioned at the center of the apparatus, and a fixing device F is positioned at a left side of the apparatus, thereby realizing a substantially horizontal conveying path. Also above the sheet conveying path, there are provided image forming means such as a process cartridge C, and light source means such as a laser scanner 5.

Such sheet feeding roller, the conveying path, the light source means, the image forming means and the fixing device execute in succession a feeding of the sheet P, a transfer of a visible image (toner image) onto the sheet P, and a fixation by heating of the visible image on the sheet P.

A size reduction of the printer decreases the heat capacity thereof because of a decrease in the volume of the printer itself, thereby showing a significant increase in the internal temperature of the apparatus. Therefore, in a compact printer, the fixing means may be positioned in an upper part of the printer, in order to increase a heat discharging efficiency. More specifically, as shown in FIG. 4, a sheet feeding tray 6 and a sheet feeding roller 2 constituting the recording material supply means are positioned in a lower side of the apparatus, while a transfer roller 9 constituting the transfer means is provided at the central portion of the apparatus, a fixing device F as the fixing means is positioned obliquely above the transfer roller 9, and an external cover, covering the fixing device F, is provided with a louvered aperture 63 for efficiently discharging the heat of the fixing device F to the exterior of the apparatus.

In such case, the conveying path is provided in an inclined position. In such inclined configuration of the conveying path, image forming means such as a process cartridge C and optical source means such as a laser scanner 5 are positioned at a same height as or lower than the fixing device F to execute a feeding of a sheet P, a transfer of the visible image onto the sheet P and a fixation of the visible image on the sheet P in succession. The sheet P after image fixation in the fixing device F assumes a position with a printed surface downward by passing through a curved discharge guide, and is discharged onto a sheet discharge tray 14 by paired discharge rollers 12.

Also a pursuit for a further size reduction of the printer and for a faster speed thereof, particularly a shorter time for the output of a first page (first printout time), leads to a printer configuration as shown in FIG. 5, in which the sheet conveying path becomes substantially vertical and minimized.

Referring to FIG. 5, in recording material feeding means S, plural sheets P are stacked on a sheet feeding tray 6. The sheet P is separated one by one by a sheet feeding roller 2 provided at the left side (rear side) of the sheet feeding tray 6, and is conveyed by conveying rollers 3*a*, 3*b* along a first guide member 52 to a transfer roller 9 constituting the transfer means.

Referring to FIG. 5, a registration sensor 4 synchronizes a leading end position of the sheet P with a light emission timing of a laser scanner 5 serving as an exposure light source, thereby writing an image from a predetermined position on the sheet P.

A process cartridge C integrally includes process means such as a photosensitive member 8 serving as an image bearing member, a toner container 60, a developing device 17, a charging roller 18 serving as a charging device, a cleaning blade 19, a cleaning container 61 etc. and is detachably mounted on the printer.

A transfer roller 9 transfers a visualized image on the photosensitive member 8 onto the sheet P. Toner which is not transferred by the transfer means including the photosensitive member 8 and the transfer roller 9 but remains on the photosensitive member 8, namely so-called residual toner, is removed off from the photosensitive member 8 by the cleaning blade 19 and is recovered into the cleaning container 61. The cleaning blade 19 is formed by an elastic member such as silicone rubber.

The sheet P after passing the transfer roller 9 is guided substantially vertically, as explained before, by a second guide member 10, and enters the fixing device F which fixes the aforementioned visible image onto the sheet P. The fixing device F is constituted of a rotatably supported pressure roller 11 and a heater unit H including a heat generating member. In the fixing device F, the heater unit H is maintained in contact with the pressure roller 11 under a predetermined pressure, and, when the sheet P passes between the pressure roller 11 and the heater unit H, the image is fixed to the sheet surface by heat and pressure.

After the image fixation in the fixing device F, the sheet P is discharged by paired discharge rollers 12 onto a sheet discharge tray 14.

The process cartridge C includes various components susceptible to heat (hereinafter represented as heat-susceptible parts) such as the toner, the photosensitive member 8, the developing device 17 including a developer carrying member, the charging roller 18, the cleaning blade 19 etc. In particular, the toner around the developing device loses the charging property at 45–50° C. or higher, thereby resulting in an image defect. Particularly within the process cartridge C, the cleaning blade 19, being constituted of an elastic material such as silicone rubber, may be curled up when softened by the heat from the fixing device F. Also the used toner particles collected by the cleaning blade 19 are fused and coagulate at a temperature of 60 to 70° C., so that appropriate recovery of the used toner may become impossible. An inappropriate recovery of the used toner may lead to an image defect such as a black streak.

In case, as shown in FIG. 5, the conveying path for the sheet P from the recording material supply means through the transfer means to the fixing means is provided substantially vertically and components of the printer are so positioned as to achieve a further compact configuration, the fixing device F is often positioned close to the process cartridge C, and, even when the fixing device F is positioned higher than the process cartridge C, the heat of the fixing device F may be transmitted to the process cartridge C thereby inflicting an detrimental influence on the process cartridge C.

In order to avoid such drawbacks, it is conceivable to sufficiently separate the process cartridge C from the fixing device F thereby reducing transmission of heat therefrom to the process cartridge C and thus suppressing the temperature elevation in the components of the process cartridge C.

However, an increased distance between the process cartridge C and the fixing device F results not only in an increase in the dimension of the entire apparatus but also in an increase in the first printout time.

There is also proposed an image forming apparatus equipped with a fan 70 for forcedly exhausting the hot air from the apparatus or inhaling the external air into the apparatus thereby preventing a temperature elevation in the apparatus.

FIGS. 6, 7 and 8 illustrate such an image forming apparatus, respectively showing configurations in which the fan 70 is provided at a lateral side, an upper side or a back side of the apparatus.

In the image forming apparatus shown in FIG. 6, a fan 70 located at a lateral side of the apparatus exhausts the air from the apparatus or inhales the external air along a transversal direction of the sheet P, as indicated by an arrow in the illustration, thereby suppressing the temperature increase in the apparatus.

Also in the image forming apparatus shown in FIG. 7, a fan 70 located at an upper side of the apparatus exhausts the air from the apparatus to the exterior, as indicated by an arrow in the illustration, thereby suppressing the temperature increase in the apparatus.

Also in the image forming apparatus shown in FIG. 8, a fan 70 located at a back side of the apparatus exhausts the air from the apparatus or inhales the external air, as indicated by an arrow in the illustration, thereby suppressing the temperature increase in the apparatus.

However, in such image forming apparatus equipped with the fan 70, in case of the configuration shown in FIG. 6, as the air is exhausted or inhaled through the lateral side of the apparatus, the sheet becomes uneven in a temperature-humidity distribution in the transversal direction and may show an uneven curl in the transversal direction after passing the fixing device F.

Also in the image forming apparatus shown in FIG. 7, in which the fan 70 is positioned at an upper side and outside the width of the sheet for exhausting the hot air from the apparatus, the sheet likewise becomes uneven in the temperature-humidity distribution in the transversal direction, whereby a detrimental effect may be inflicted on the sheet curling after the fixation.

Further, in case the fan 70 is positioned at the back side as shown in FIG. 8, the process cartridge C which is most susceptible to heat and the fan 70 are mutually opposed across the conveying path for the sheet P. Therefore, the air circulated by the fan 70 is intercepted by such conveying path and cannot reach the process cartridge C, thus resulting in a poor cooling efficiency for the process cartridge C.

Besides, any of the configurations shown in FIGS. 6 to 8 is not favorable in the external appearance of the apparatus, with the fan 70 extruding from the outer wall of the apparatus or with the louver for covering the fan 70 being exposed to the exterior.

Also a configuration in which the fan 70 does not protrude from the outer wall leads to a larger apparatus as a space for installing the fan 70 has to be secured inside the apparatus.

Also in case the fan is exposed to the outer wall of the apparatus, disturbing noises are generated by the motor and the fan 70.

Furthermore, in any of the configurations shown in FIGS. 6 to 8, as the process cartridge C, which is most vulnerable to heat, is in a position distant from the fan 70, a large fan is required for sufficiently cool the process cartridge C, thus constituting an obstacle in realizing a smaller dimension, a lower cost and a lower noise level.

SUMMARY OF THE INVENTION

In consideration of the foregoing, an object of the present invention is to provide an image forming apparatus capable of efficiently cooling a process cartridge without being influenced by a heat from fixing means.

Another object of the present invention is to provide an image forming apparatus including supply means which supplies a recording material, a cartridge provided with a photosensitive member and image forming means which acts on the photosensitive member and detachably mounted on a main body of the apparatus, fixing means which fixes an unfixed image onto the recording material, and air blower means provided between the supply means and the cartridge, wherein the cartridge forms an unfixed image on the recording material supplied and conveyed by the supply means, the supply means, the cartridge and the fixing means are positioned in this order from below to above, and the air blower means blows air toward the cartridge.

Still other objects of the present invention will become fully apparent from the following description.

DETAILED DESCRIPTION OF THE PREFERRED EMBODIMENTS

In the following, embodiments of the present invention will be explained with reference to the accompanying drawings.

Figure 1:
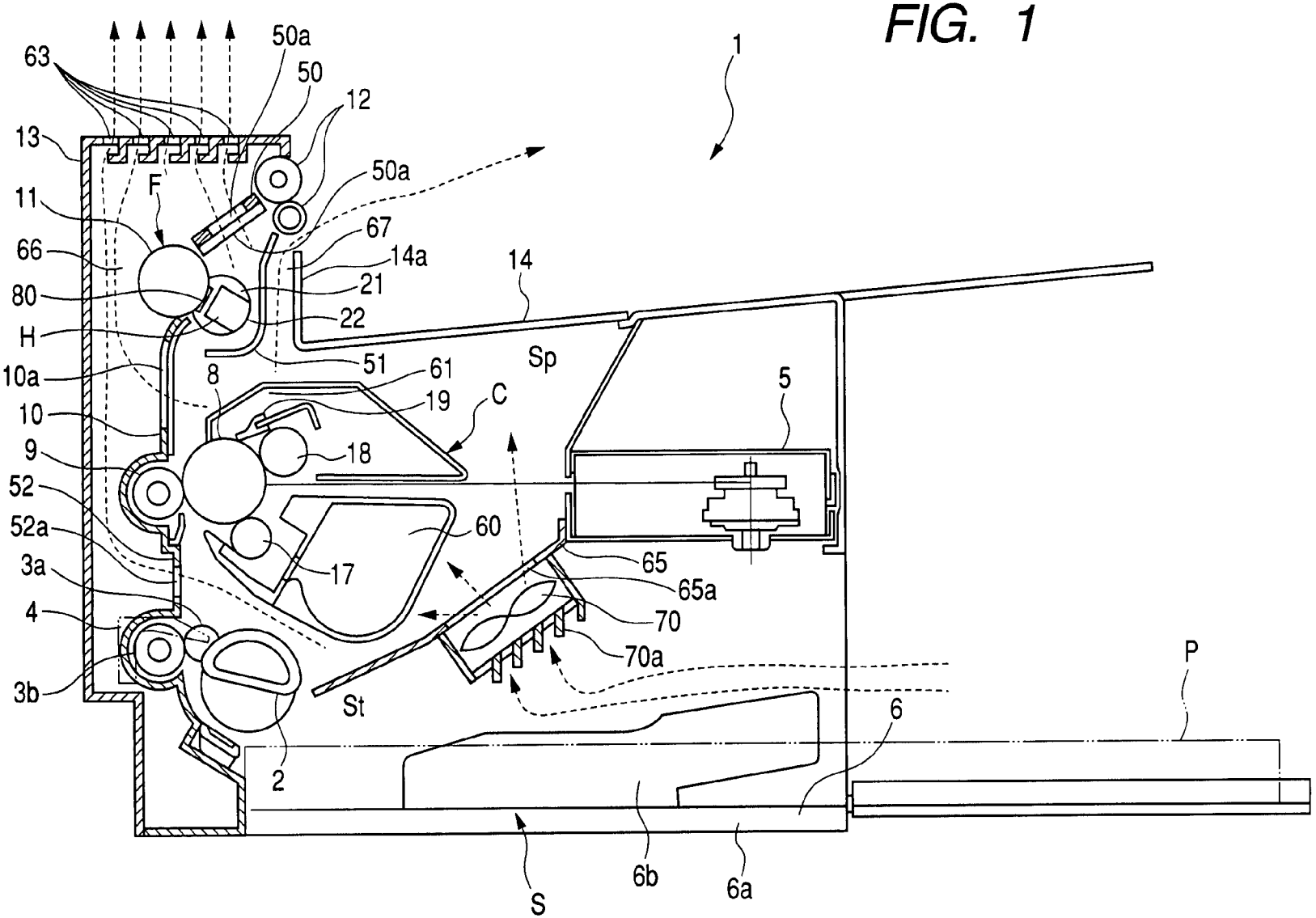
FIG. 1 is a view showing an image forming apparatus embodying the present invention.

FIG. 1 is a cross-sectional view of a laser beam printer 1 constituting the image forming apparatus of the present invention and utilizing an electrophotographic recording process by scanning a photosensitive member 8 with a laser beam.

Referring to FIG. 1, recording material supply means S is provided with a sheet feeding tray 6, constituting recording material containing means which supports recording materials or sheets P in a stacked state and is detachably mounted to a main body of the apparatus in a substantially horizontal position and in a state exposed to the external air, and a sheet feeding roller 2 constituting recording material separating/feeding means which feeds the sheet P, stacked on the sheet feeding tray 6, toward the main body of the apparatus. The sheet feeding tray 6 includes a sheet supporting plate 6*a* and a lateral plate 6*b* constituting a lateral face of the sheet supporting plate 6*a*.

The sheet feeding roller 2 is provided at the left side of the apparatus, when seen from a position in front of FIG. 1, and separates and feeds the sheet P one by one into the interior of the apparatus. Conveying rollers 3*a*, 3*b* are provided adjacent to the sheet feeding roller 2, and the sheet P separated by the sheet feeding roller 2 is conveyed by the conveying rollers 3*a*, 3*b* and along a first guide member 52 extending substantially vertically toward a transfer roller 9 constituting transfer means.

A registration sensor 4 is provided for synchronizing a leading end position of the sheet P with a light emission timing of a laser scanner 5 serving as an exposure light source, thereby recording an image from a predetermined position on the sheet P. The laser scanner 5 is positioned above the lateral plate 6*b* of the sheet feeding tray 6.

A process cartridge C is provided in the apparatus, in an upper right position to the registration sensor 4.

The process cartridge C includes a photosensitive member 8 serving as an image bearing member, and also integrates process means such as a toner container 60, a developing device (developing means) 17, a charger (charging means) 18, a cleaning blade (cleaning means) 19, a cleaning container 61 etc., and is rendered detachably mountable on the main body of the apparatus.

A transfer roller 9 is maintained in contact with the photosensitive member 8 of the process cartridge C and serves to transfer a visualized image (toner image), formed on the photosensitive member 8, onto the sheet P. Toner that has not been transferred, or so-called residual toner, is removed off from the photosensitive member 8 by the cleaning blade 19 and is recovered in the cleaning container 61. The cleaning blade 19 is formed by an elastic member such as of silicone rubber.

The first guide member 52 is connected to a second guide member 10 provided in continuous manner and extending vertically. The sheet P after passing the transfer roller 9 is conveyed substantially vertically along the second guide member 10 and reaches a fixing device F positioned in the vicinity of the end of the second guide member 10. The fixing device F constitutes fixing means which fixed the visualized image to the sheet P by heating.

The fixing device F is provided with a rotatably supported pressure roller 11 and a heater unit H including a heat generating member, and the heater unit H is pressed to the pressure roller 11 under a predetermined pressure. The sheet P passes between the pressure roller 11 and the heater unit H, whereupon the image is fixed to the surface of the sheet P by the heat of the heater unit H and the pressure of the pressure roller 11.

When the recording materials, or the materials to be heated, are passed in continuous manner, the heater unit H may reach a temperature of 140 to 170° C. while the pressure roller 11 may reach a temperature of 110 to 150° C. Consequently, the heater unit H is covered with a heat insulation cover 51, in order to prevent eventual burning of the user or heating of other components in the process cartridge C or in the image forming apparatus.

A sheet discharge guide 50 formed with a heat-resistant plastic material is provided parallel to a conveying direction of the recording material, above the heat insulation cover 51 and at a downstream side of a fixing nip portion 80 in the conveying direction of the recording material. Paired sheet discharge rollers 12 are positioned at the downstream side of the sheet discharge guide 50.

When the recording material reaches the sheet discharge guide 50, it is guided by the sheet discharge guide 50 to the paired sheet discharge rollers 12. After reaching the paired sheet discharge rollers 12, the recording material is discharged, with a printed surface downwards, onto a sheet discharge tray 14 which also serves as a top plate of the apparatus. An end portion 14*a* of the sheet discharge tray 14 is bent in a right angle, and an end of the bent portion is somewhat distanced from the paired sheet discharge rollers 12. The end portion 14*a* will hereinafter be called a vertical wall for the convenience of explanation.

In the present embodiment, as explained in the foregoing and illustrated in FIG. 1, the process cartridge C is positioned above the recording material supply means S, and the fixing device F is positioned above the process cartridge, and the fan 70 is provided between the recording material supply means (particularly recording material containing means) S and the process cartridge C. The conveying path for the sheet P is constituted by the sheet feeding roller 2, the first guide member 41, the photosensitive member 8 and the transfer roller 9, the second guide member 10, the fixing device F and the sheet discharge guide 50, and extends substantially perpendicularly to the sheet feeding tray 6. In summary, this conveying path conveys the sheet P, stacked on the sheet feeding tray 6, by the sheet feeding roller 2 and the transfer roller 9 to the fixing device F.

In such conveying path, the first guide member 52, the second guide member 10 and the sheet discharge guide 50 are respectively provided with a first ventilation hole 52*a*, a second ventilation hole 10*a* and a third ventilation hole 50*a*.

Also in a side of the apparatus opposite to the side of the process cartridge C across the conveying path, there is formed a first air path 66 leading to a louver 63 constituting an air exhaust aperture (aperture portion) provided in the main body (more specifically an outer cover 13) of the apparatus. The air path 66 communicates with the first ventilation hole 52*a*, the second ventilation hole 10*a* and the third ventilation hole 50*a*, and the air entering the air path 66 from these ventilation holes reaches the louver 63 through the first air path 66. The fixing device F is positioned under the louver 63.

On the other hand, between the heat insulation cover 51 and the vertical wall 14*a* of the sheet discharge tray 14, there is formed a second air path 67, which connects a space Sp at the process cartridge to be explained in the following directly with the exterior of the apparatus. An exit port of the second air path 67 is positioned above the sheet discharge tray 14.

Between the process cartridge C and the sheet feeding tray 6, there is provided a partition wall 65 which constitutes a separating member for separating the interior of the apparatus into a space Sp at the side of the process cartridge and a space St at the side of the sheet feeding tray 6. The space Sp at the side of the process cartridge is a closed space shielded from the exterior of the apparatus, while the space St at the side of the sheet feeding tray is an open space exposed to the exterior of the apparatus, since the sheet feeding tray is mounted in a state exposed to the exterior. Above the sheet feeding tray, the external air can flow from the exterior to the interior of the apparatus. A gap is present between the sheet feeding tray and the outer cover thereabove, and sheets can be stacked within such gap and, in such stacked state of the sheets, a gap is formed between the sheets and the outer cover.

The closed space Sp is not tightly closed, but is in a state less easily contactable with the external air in comparison with the open space St which is in positive contact with the external air.

The partition wall 65 is slightly bent in a central portion to have a chevron-shaped cross section, and is fixed at an end to the laser scanner 5.

The partition wall 65 is also provided with an aperture or a ventilation hole 65*a*, in which provided is a fan 70 constituting air blowing means for feeding the external air from the open space St to the closed space Sp.

Within the partition wall 65, the ventilation hole 65*a* is provided in a position opposed to the process cartridge C. More specifically, the partition wall 65 is provided above the sheet feeding tray 6, and the ventilation hole 65*a* is formed at the center in a direction perpendicular to the conveying direction of the sheet P on the sheet feeding tray 6, so as to be opposed to the process cartridge C. For example, in case of conveying a rectangular sheet such as an A4-sized sheet with a longer side thereof parallel to the conveying direction, the ventilation hole 65*a* is opposed to a central portion in the transversal direction of such sheet.

The fan 70 is provided, at the side of the recording material supply means S, with a fan louver 70*a* for avoiding eventual contact of the user with the fan. The fan louver 70*a* has downward angled apertures in order to intercept the external light entering horizontally from the side of the recording material supply means S. Thus the photosensitive drum 8 can be protected from the external light.

The fan 70 inhales the air in the vicinity of the recording material supply means S, which is in communication with the external air, into the side of the process cartridge C, thereby introducing the external air into the process cartridge C through the ventilation hole 65*a* provided in the partition wall 65. Since the recording material supply means S is in communication with the external air, an air temperature at the recording material supply means S is almost same as that of the external air.

When the image forming apparatus starts a printing operation, the process cartridge C provided close to the fixing device F is heated principally by the heat therefrom, but the external air inhaled by the fan 70 into the interior of the apparatus is directly blown to and directly cools the process cartridge C.

Thereafter, the air, present around the process cartridge C and warmed by cooling the process cartridge C, is divided into a flow passing through the first ventilation hole 52*a* and the second ventilation hole 10*a* and directed to the louver 63 through the first air path 66, and a flow directed toward the second air path, and is discharged from the apparatus while cooling the fixing device F which is hotter than the process cartridge C.

In the present embodiment, as explained in the foregoing, the open space St at the side of the sheet feeding tray is in contact with the external air. Consequently, by the function of the fan 70, the external air is introduced from the space St at the side of the sheet feeding tray, through the ventilation hole 65*a* of the partition wall 65, into the closed space Sp at the side of the process cartridge, whereby the external air is supplied to the process cartridge C. Therefore, an improved cooling effect can be obtained for the process cartridge C.

Also within the partition wall 65, the ventilation hole 65*a* is formed in a position opposed to the process cartridge C, so that the external air is directly blown thereto. It is thus rendered possible to efficiently suppress the temperature increase in the process cartridge C, including the toner and the heat-susceptible parts such as the photosensitive member 8, the developing device 17 containing a developer carrying member, the charging roller 18, and the cleaning blade 19. It is thus possible to prevent thermal breakage of the heat-susceptible parts and an image defect resulting therefrom. Furthermore, since a sufficient cooling effect can be expected, the fan 70 can be made smaller to achieve a smaller configuration of the apparatus.

As the ventilating hole is provided in a position opposed to a central portion in a direction (transversal direction) perpendicular to the conveying direction of the sheet P on the sheet feeding tray 6, the fan provided in the ventilating hole is also opposed to the central portion in the direction perpendicular to the conveying direction of the sheet P.

Therefore the air flowing on the surface of the sheet P forms a uniform undeviated flow thereby realizing a uniform temperature-humidity distribution in the sheet P. Thus the curl in the sheet P after heating in the fixing device can be made uniform in a direction perpendicular to the conveying direction of the sheet P.

Also the main body of the apparatus is provided with the louver 63 connected with the first air path 66 and the second air path 67, and the air of high temperature in the apparatus is exhausted to the exterior through these air paths.

In particular, as the fixing device F is positioned under the louver 63, the internal air warmed by the heat from the fixing device F can be exhausted to the exterior through the louver 63 whereby a high temperature formation in the apparatus can be avoided.

Also in the present embodiment, since the process cartridge C is positioned above the recording material supply means S and the fixing device F is positioned above the process cartridge C, the air introduced into the apparatus by the fan 70 is exhausted from the apparatus through the louver 63, and, in such course, the air passing through the process cartridge C pushes upwards the air around the fixing device F, thereby avoiding a backward flow of the air, warmed by the fixing device F, within the apparatus.

For this reason, it is possible, even when the fixing device F is positioned close to the process cartridge C, to avoid heating of the process cartridge C by the heat generated by the fixing device F. It is thus made possible to shorten the conveying path for the sheet P, thus allowing to reduce the dimension of the apparatus in combination with the use of a smaller fan 70. Further, a decreased dimension of the apparatus allows to achieve a shorter first printout time.

Also the fan 70 of a smaller size is provided in a rear position above the recording material supply means S and less visible to the user, thus not providing a detrimental effect on the design of the apparatus.

Furthermore, such positioning of the small fan 70 in the rear position above the recording material supply means S renders the motor noise and the air noise of the fan 70 less audible to the user.

Furthermore, in such positioning of the fan 70 in the rear position above the recording material supply means S, in contrast to the case where the fan 70 is provided in the lateral side or the upper side of the apparatus, the external light cannot easily reach the photosensitive drum 8, so that a light-shielding configuration such as a complex duct can be dispensed with.

Therefore, the above-explained configuration allows to provide an image forming apparatus that minimize the distance between the fixing device F and the process cartridge C, while maintaining the external appearance, the noise level and the cost at satisfactory level.

In the following, another embodiment will be explained with reference to FIG. 2.

In a laser beam printer 90 of the present embodiment, portions similar to those in the laser beam printer 1 of the foregoing embodiment will not be explained further.

The foregoing embodiment shows a case where the present invention is applied to an image forming apparatus having a substantially vertical conveying path for the sheet P. In contrast, the present embodiment shows a case where the present invention is applied to an image forming apparatus in which, as shown in FIG. 2, a conveying path for the sheet P, extending from the recording material supply means through the transfer means to the fixing means, is provided in an inclined direction with respect to a sheet feeding tray 6 which is provided substantially horizontally in the main body of the apparatus.

Figure 2:
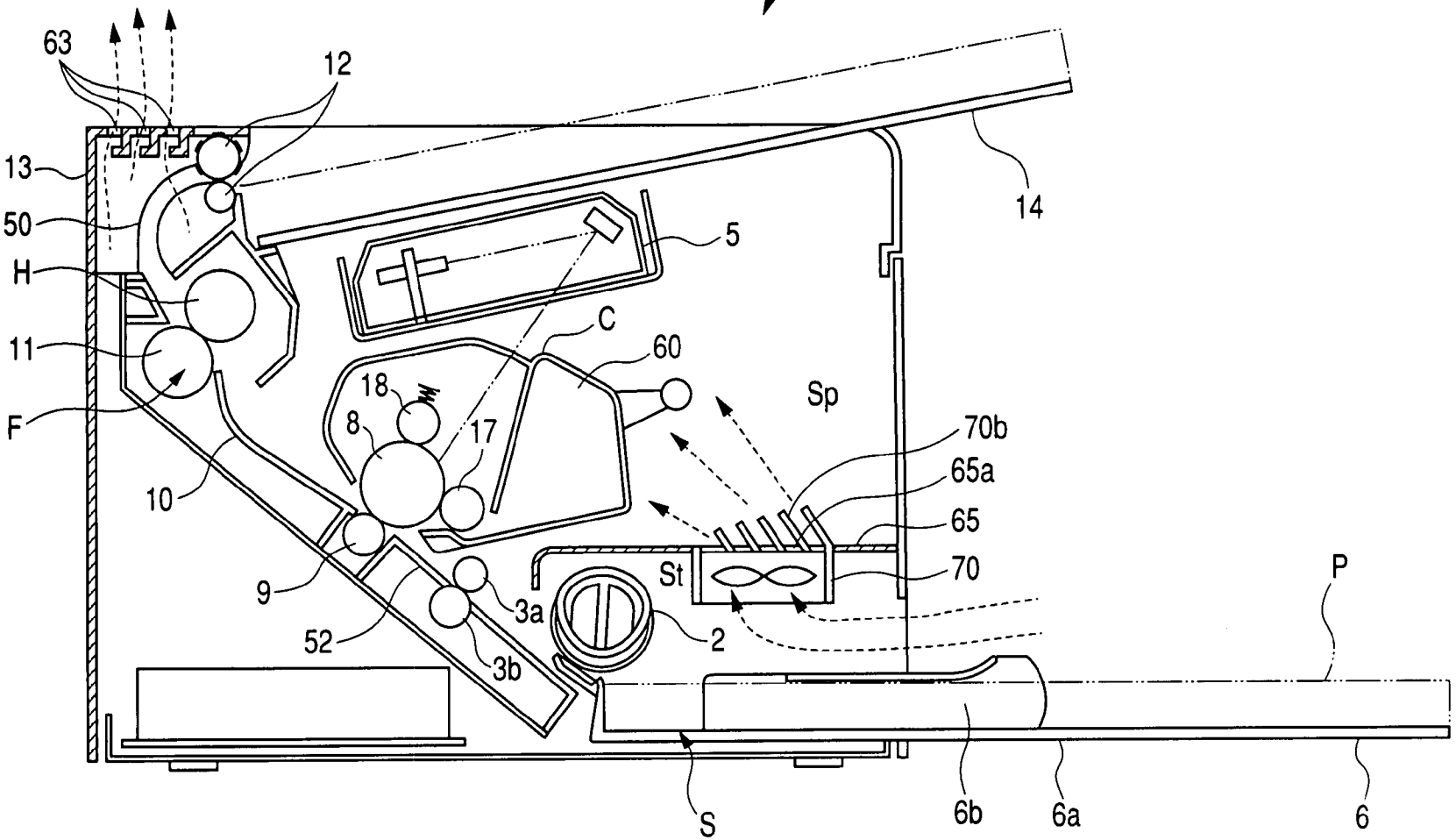
FIG. 2 is a view showing an image forming apparatus constituting another embodiment of the present invention.
Figure 3:
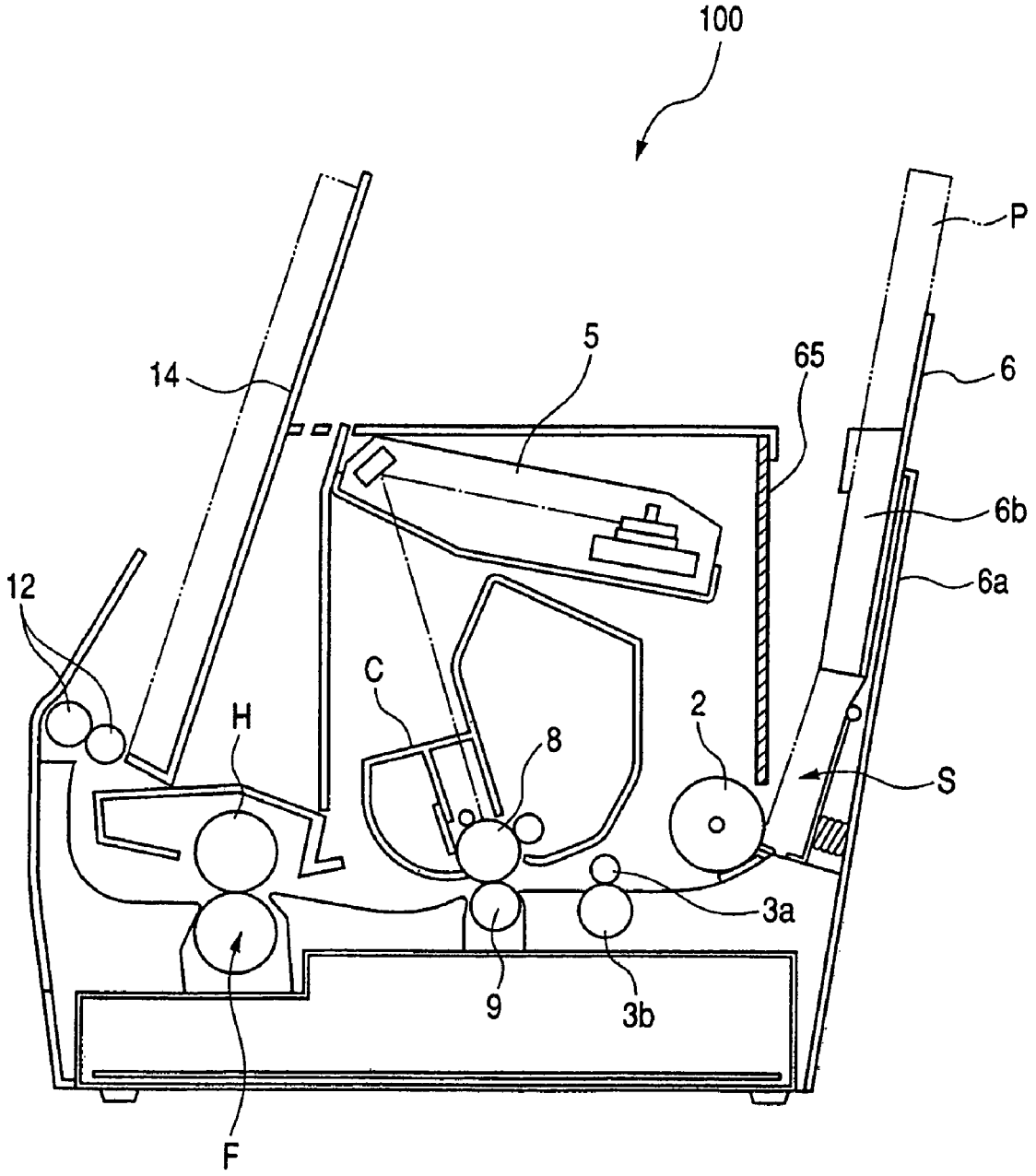
FIG. 3 PRIOR ART
FIG. 3 is a cross-sectional view of an image forming apparatus (with a substantially horizontal conveying path) constituting a background technology of the present invention.
Figure 4:
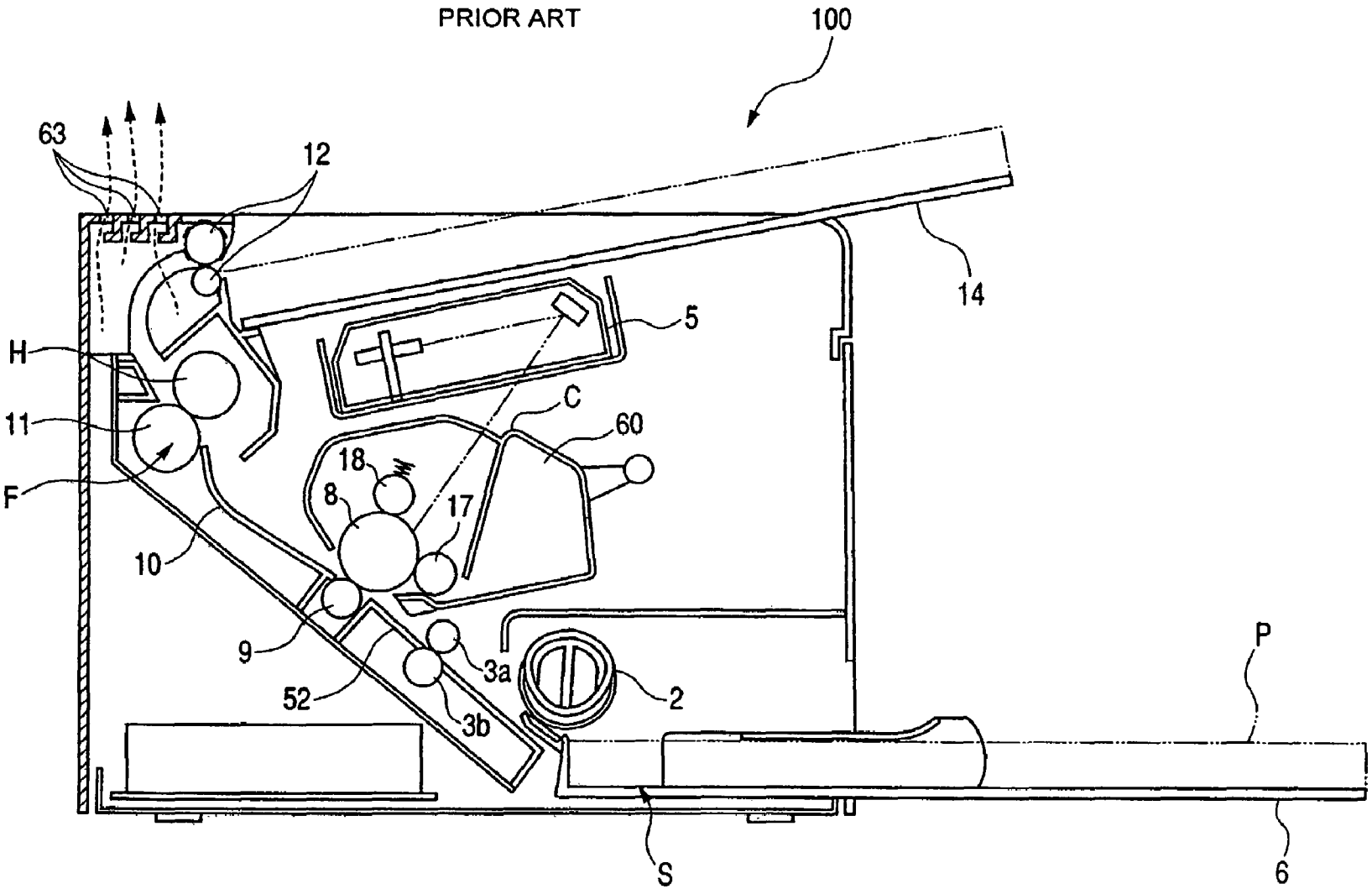
FIG. 4 PRIOR ART
FIG. 4 is a cross-sectional view of an image forming apparatus (with an inclined conveying path) constituting a background technology of the present invention.
Figure 5:
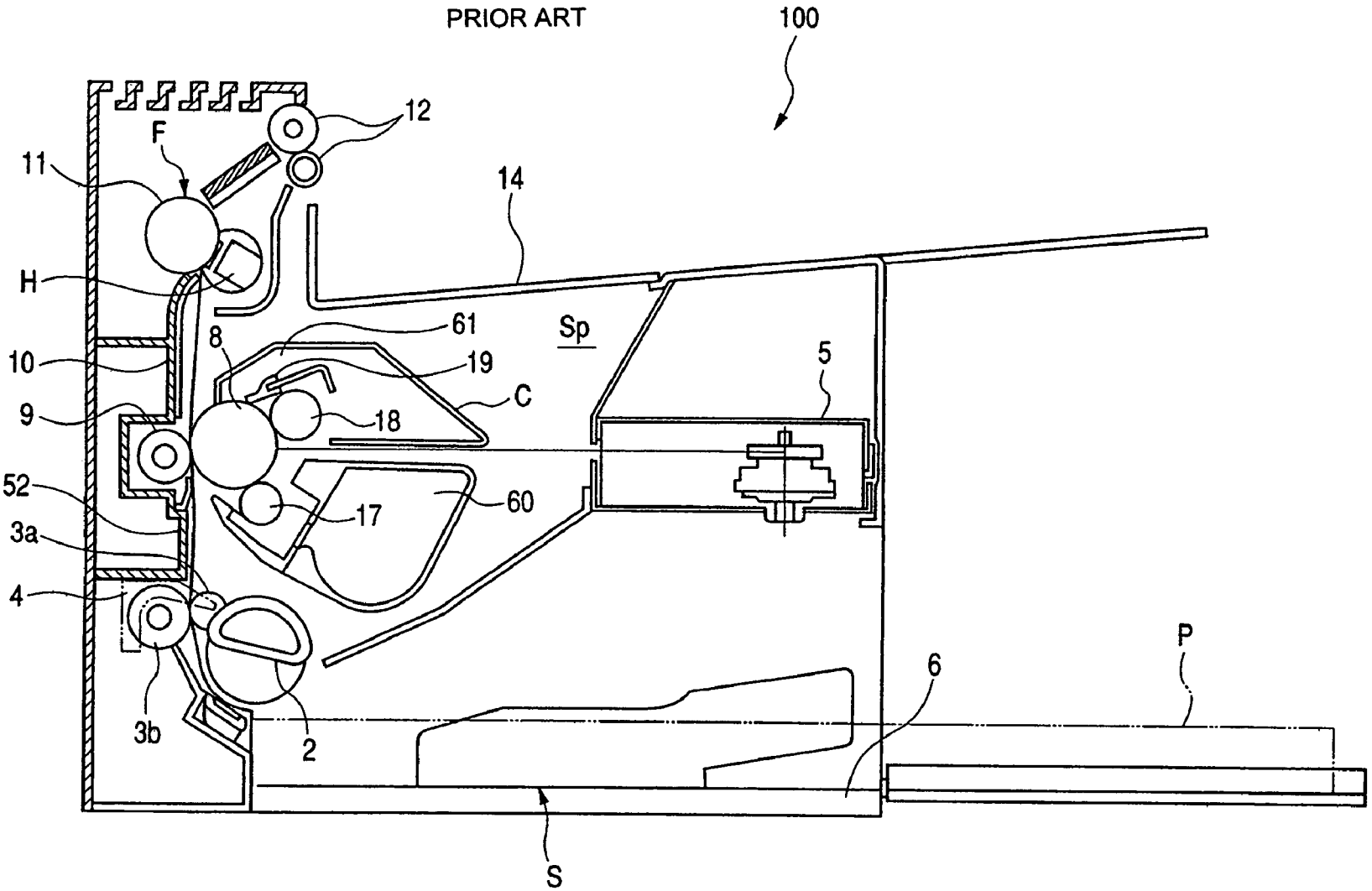
FIG. 5 PRIOR ART
FIG. 5 is a cross-sectional view of an image forming apparatus (with a substantially vertical conveying path) constituting a background technology of the present invention.
Figure 6:
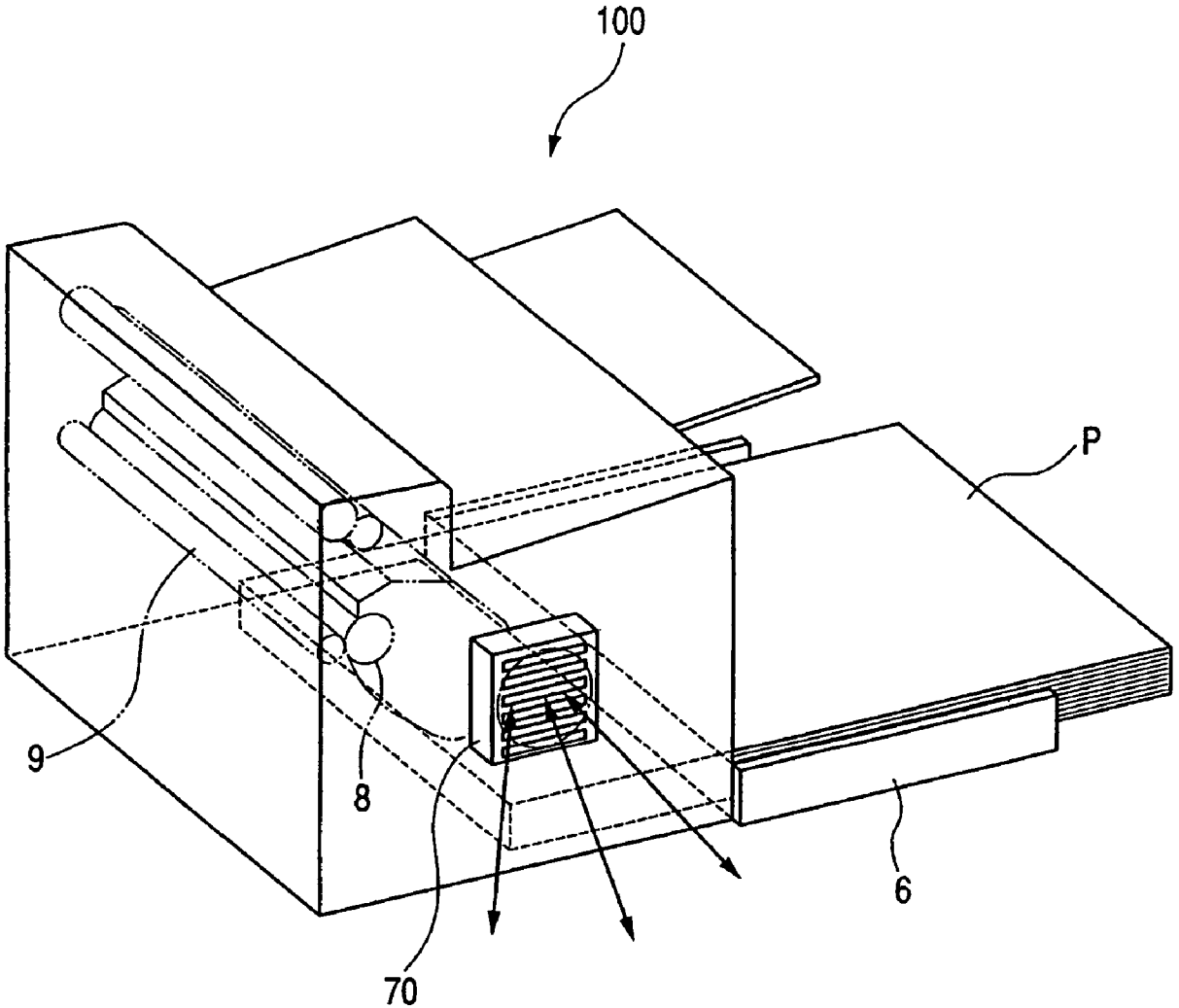
FIG. 6 PRIOR ART
FIG. 6 is a view showing an image forming apparatus constituting a background technology of the present invention, in which a fan is provided at a lateral side of the apparatus.
Figure 7:
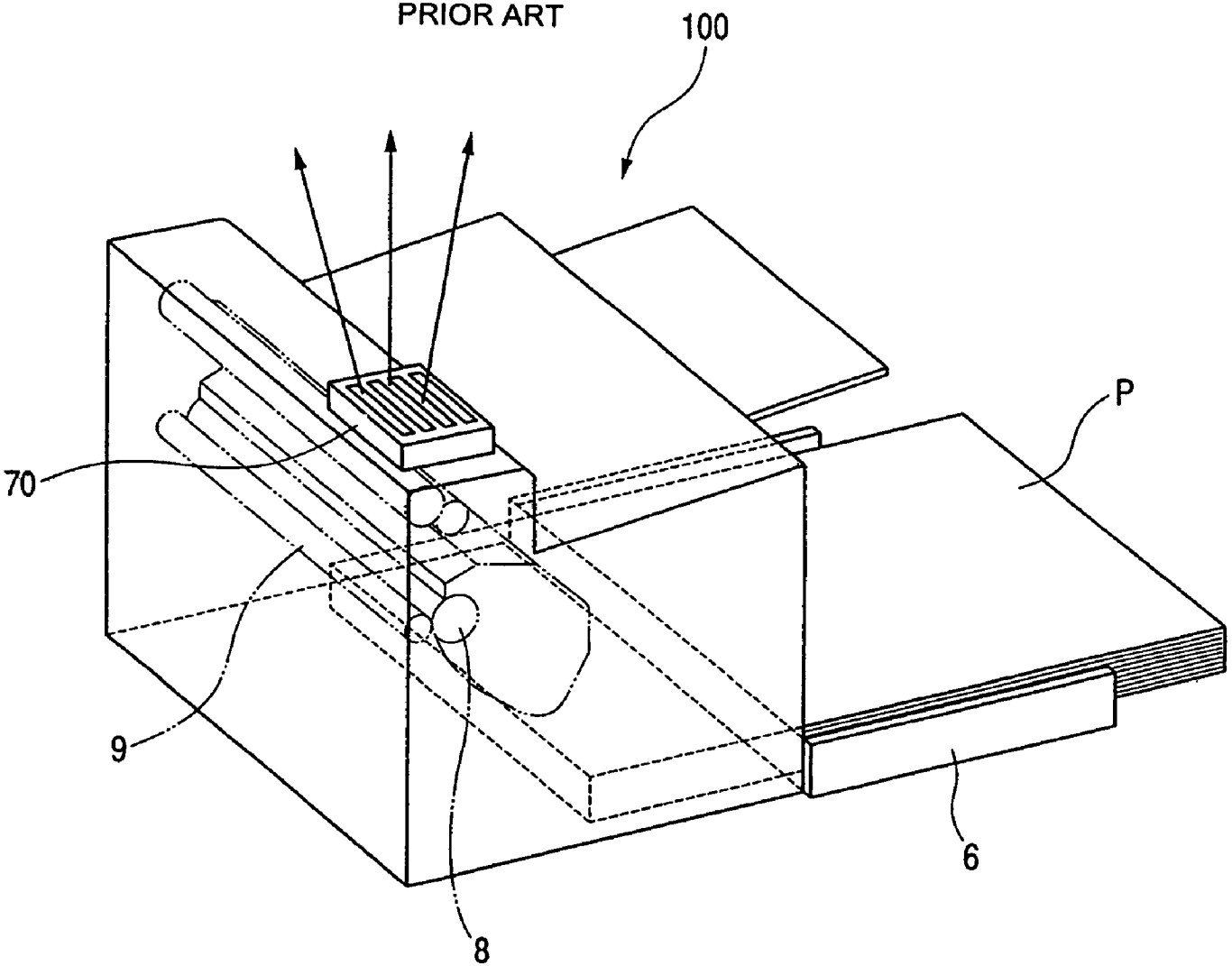
FIG. 7 PRIOR ART
FIG. 7 is a view showing an image forming apparatus constituting a background technology of the present invention, in which a fan is provided in an upper side of the apparatus.
Figure 8:
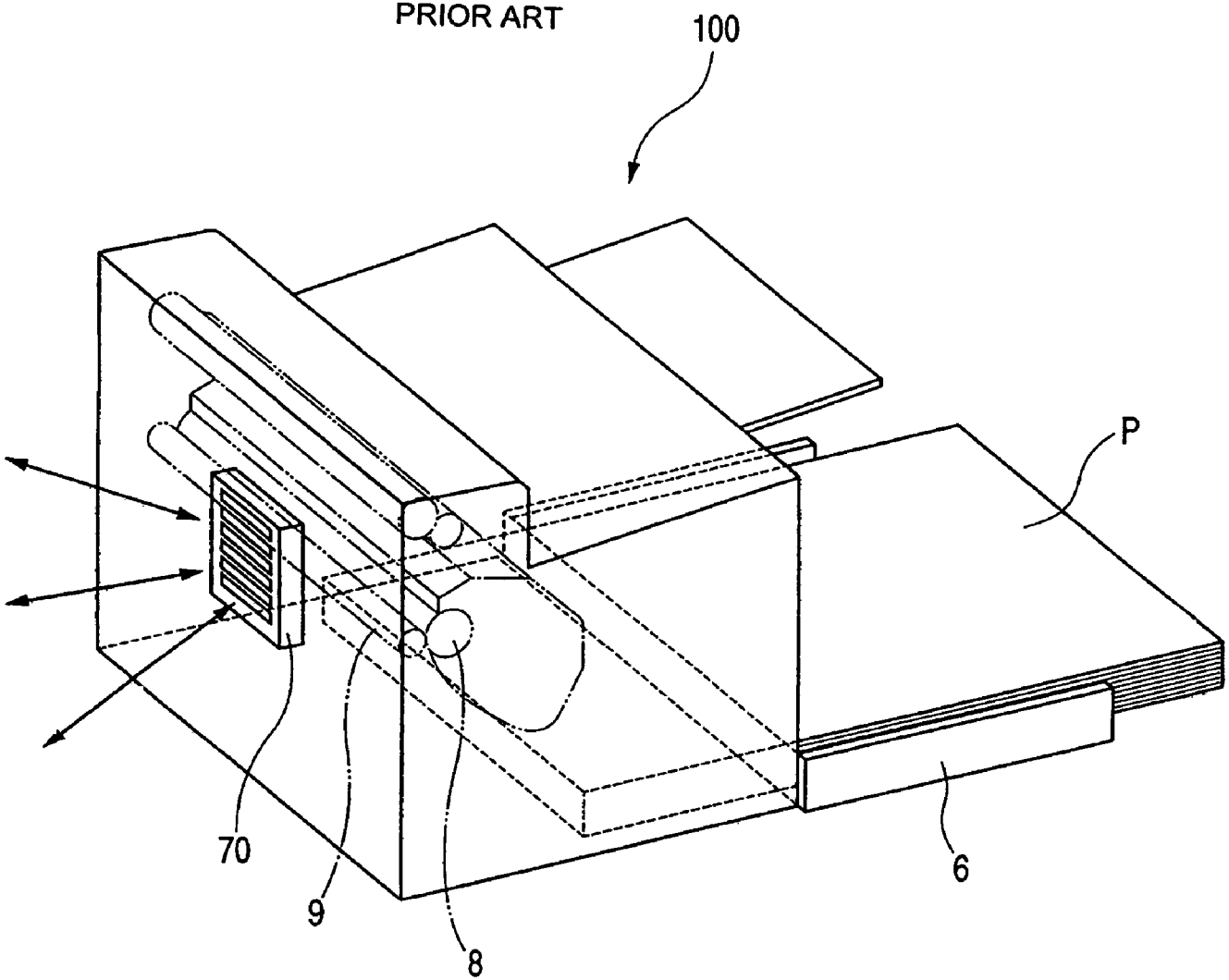
FIG. 8 PRIOR ART
FIG. 8 is a view showing an image forming apparatus constituting a background technology of the present invention, in which a fan is provided at a back side of the apparatus.

More specifically, in the image forming apparatus shown in FIG. 2, a conveying path for the sheet P is formed by a sheet feeding roller 2, a first guide member 52, a photosensitive drum 8 and a transfer roller 9, a second guide member 10, a fixing device F, a sheet discharge guide 50 etc. and is provided in an inclined position with an angle of about 30 to 60° with respect to the sheet feeding tray 6. Thus the recording material is conveyed obliquely upward from the recording material supply means to the fixing means. Also in the present embodiment, a process cartridge C is provided above the recording material supply means S, and a fixing device F is provided above the process cartridge C.

Also a laser scanner 5 is provided above the process cartridge C.

A partition wall 65 is mounted parallel to the sheet feeding tray 6. The partition wall 65 is provided with a ventilation hole 65*a*, and a fan 70 is mounted on the partition wall 65 at the ventilation hole 65*a* (more exactly so as to be opposed to the ventilation hole 65*a*). The partition wall 65 is provided, on a surface thereof at the side of the process cartridge, with a deflecting plate 65*b* for directing the air, inhaled by the fan 70 from the space St at the side of the sheet feeding tray 6 into the space Sp at the side of the process cartridge C, toward the process cartridge C.

Also this embodiment provides, like the foregoing embodiment, effects of achieving a smaller dimension, a lower cost and a lower noise level of the apparatus, also not detrimentally affecting the appearance of the apparatus by the presence of the fan and efficiently suppressing the temperature elevation in the process cartridge and components of the apparatus even without employing a large-sized fan.

The present invention has been explained by embodiments thereof, but the present invention is by no means limited to such embodiments and is subject to any and all modifications within the technical spirit of the present invention.

This application claims priority from Japanese Patent Application No. 2003-304552 filed Aug. 28, 2003, which is hereby incorporated by reference herein.

What is claimed is:

1. An image forming apparatus comprising:

a supply device which supplies a recording material;

a cartridge including a photosensitive member and image forming device which acts on said photosensitive member, and detachably mounted on a main body of the apparatus, the cartridge being capable of forming an unfixed image on the recording material supplied and conveyed by said supply device;

a fixing device which fixes the unfixed image onto the recording material;

wherein said supply device, said cartridge and said fixing device are positioned from below to above in this order, an air blowing device which blows air toward said cartridge;

a separating member for separating a space at a side of said cartridge and a space at a side of said supply device, said separating member including an aperture portion, said aperture portion being opposed to said cartridge, said air blowing device being provided at the aperture portion; and an aperture for discharging the air from an interior of said apparatus to an exterior of said apparatus, wherein said aperture is provided above said fixing device.

2. An image forming apparatus according to claim 1, wherein said supply device includes container device which contains the recording material, and external air can flow above said container device, from an exterior of the apparatus to an interior of the apparatus.

3. An image forming apparatus according to claim 1, wherein said air blowing device is provided at a central portion of the apparatus, in a direction perpendicular to a conveying direction of the recording material.

4. An image forming apparatus according to claim 1, wherein a conveying path for the recording material from said supply device to said fixing device extends in a substantially vertical direction.

5. An image forming apparatus according to claim 1, wherein the conveying path for the recording material from said supply device to said fixing device extends in an inclined upward direction.

6. An image forming apparatus according to claim 1, wherein said image forming device is at least one of charging device, developing and cleaning device.

* * * * *